US005363349A

United States Patent [19]

Huang

[11] Patent Number: 5,363,349

[45] Date of Patent: Nov. 8, 1994

[54] CLOCK ASSEMBLY HAVING A ROTATING DEVICE

[76] Inventor: Fu-Bing Huang, 58, Ma Yuan West St., Taichung, Taiwan, Prov. of China

[21] Appl. No.: 228,582

[22] Filed: Apr. 18, 1994

[51] Int. Cl.[5] ..... G04B 21/02

[52] U.S. Cl. ..... 368/75; 368/274

[58] Field of Search ..... 368/72–75, 368/229, 272–274

[56] References Cited

U.S. PATENT DOCUMENTS

| | | | |
|---|---|---|---|
| 3,376,700 | 4/1968 | Davis et al. | 368/274 |
| 3,581,410 | 6/1971 | Zeiger et al. | 368/274 |
| 4,097,905 | 6/1978 | Kramer | 368/12 |
| 4,730,284 | 3/1988 | Adams | 368/72 |
| 4,993,006 | 2/1991 | Oshima et al. | 368/231 |
| 5,047,998 | 7/1991 | Aizawa et al. | 368/75 |
| 5,124,959 | 6/1992 | Yamalda et al. | 368/231 |

*Primary Examiner*—Vit W. Miska

[57] ABSTRACT

A clock includes a base, a seat and a frame fixed above the base, a motor fixed on the seat, a tape device for telling time being disposed in the base and coupled to the motor so as to be driven by the motor. A head, a body, an arm, a leg are supported on the frame and coupled to the motor so as to be rotated by the motor in order to simulate the head, the body, the arm and the leg of creature.

4 Claims, 5 Drawing Sheets

CLOCK ASSEMBLY HAVING A ROTATING DEVICE

BACKGROUND OF THE INVENTION

1. Field of the Invention

The present invention relates to a clock assembly, and more particularly to a clock assembly having a rotating device.

2. Description of the Prior Art

Typical clocks comprise a clock body having a surface, at least two pointers rotatably supported in the surface for indicating time, the surfaces are usually printed with various kinds of patterns for decoration purposes. However, the patterns may not move.

The present invention has arisen to mitigate and/or obviate the afore-described disadvantages of the conventional clocks.

SUMMARY OF THE INVENTION

The primary objective of the present invention is to provide a clock assembly which includes a rotating device provided therein.

In accordance with one aspect of the invention, there is provided a clock assembly including a base, a seat and a frame fixed above the base, a motor fixed on the seat, a tape device for telling time being disposed in the base and coupled to the motor so as to be driven by the motor, a spindle rotatably supported on the frame, means coupling the tape to the spindle for rotating the spindle when the tape is driven by the motor, a lever having a first end secured to the spindle and rotated in concert with the spindle and including an extension extended upward therefrom, a rod rotatably supported on the frame and including a leg laterally extended therefrom and having a groove formed therein for engaging with the extension of the lever such that the rod is rotated when the lever is rotated by the motor, a head fixed on top of the rod and rotated in concert with the rod for simulating head of creature.

The assembly includes a body for simulating body of creature, an arm for simulating arm of creature, and a leg for simulating leg of creature.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
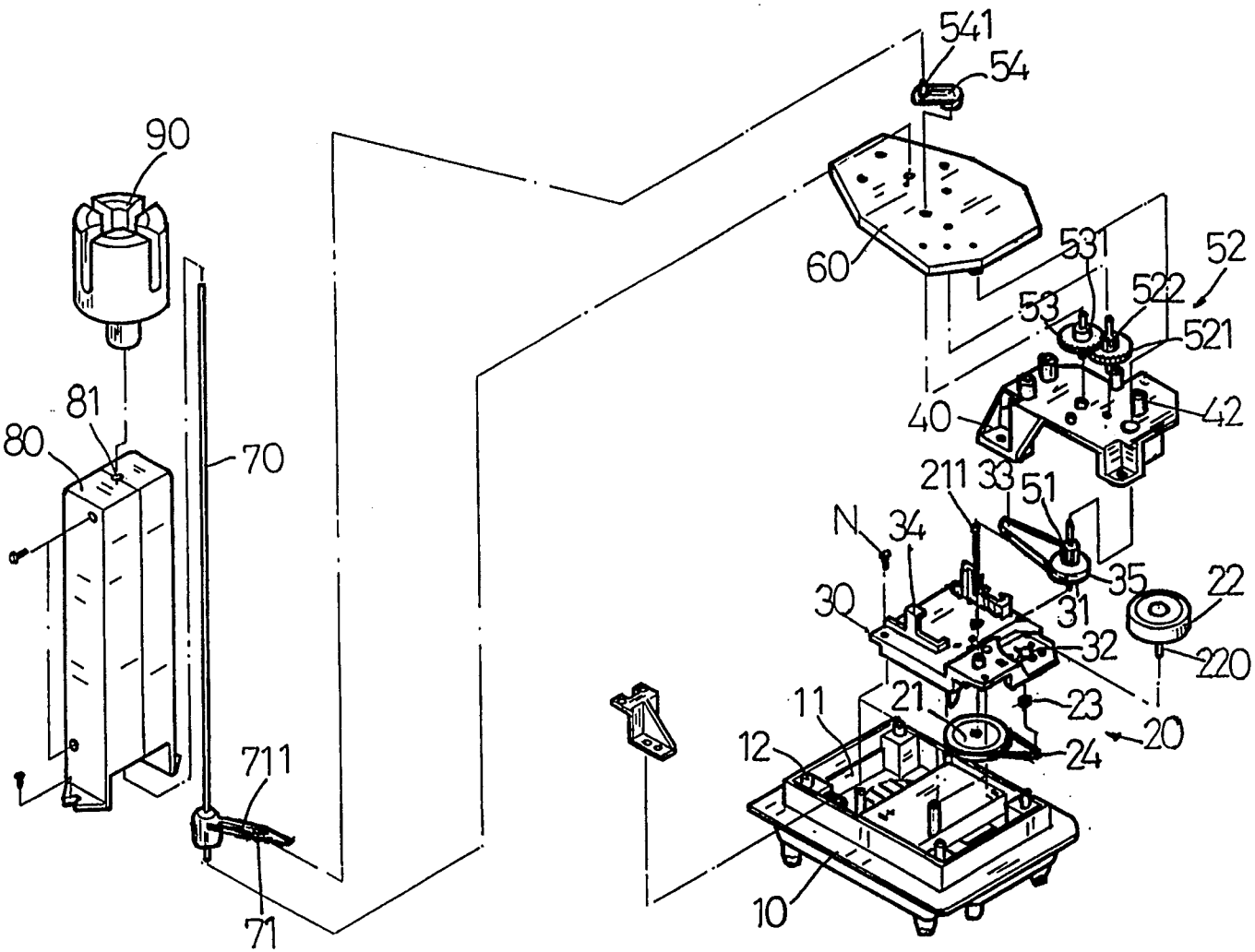
FIG. 1 is an exploded view of a clock assembly in accordance with the present invention.

Referring to the drawings, and initially to FIG. 1, a clock assembly in accordance with the present invention comprises a base 10 including a space 11 formed therein for receiving a tape device 20, four stubs 12 extended upward from the base 10, a seat 30 and a frame 40 fixed to the stubs 12 by screws N, the tape device 20 including a tape 21 recorded with suitable music and words for telling time, a motor 22 disposed in a depression 31 of the seat 30 and including an axle 220 extended downward through a hole 32 of the seat 30, a pulley 23 fixed to the axle 220 and coupled to the tape 21 with a belt 24 such that the tape 21 may be operated by the motor 22, a shaft 211 extended through a hole of the seat 30 and secured to the tape 21, a pulley 35 rotatably supported between the seat 30 and the frame 40 and coupled to the shaft 211 with a belt 33 such that the pulley 35 may be rotated by the motor 22 via the belts 24, 33 the tape 21 and the shaft 211, a pinion 51 formed integral with the pulley 35, and two hooks 34 extended upward from the seat 30 for engaging with the frame 40 so as to further retain the frame 40 in place.

The frame 40 includes a number of stubs 42 extended upward therefrom for supporting a board 60 thereon, the pinion 51 is extended upward beyond the board 60, a gearing mechanism 52 is provided between the frame 40 and the board 60 and includes a gear 521 engaged with the pinion 51, another pinion 522 formed integral with the gear 521, another gear 53 engaged with the pinion 522, and the gear 53 having a spindle 531 extended upward through the board 60 for engaging with one end of a lever 54 which includes an extension 541 extended upward therefrom, a rod 70 rotatably supported on the board 60 and including a leg 71 laterally extended therefrom and having a groove 711 formed therein for engaging with the extension 541 of the lever 54 such that the rod 70 can be rotated when the lever 54 is rotated by the gearing 52, a casing 80 fixed on the board 60 and including an aperture 81 for engaging with the rod 70 such that the rod 70 may be stably supported in place, and a head 90 fixed on top of the rod 70 and rotated in concert with the rod 70 for simulating the head of creature.

In operation, the head 90 and the rod 70 are rotated in a reciprocating type act ion by engagement between the extension 541 and the groove 711 of the 71 when the lever 54 is rotated, the lever 54 is rotated by the gearing 52 which is actuated by the motor 22. It is preferable that the head 90 and the rod 70 move one cycle for one second, i . e ., the leg 71 rotates from a starting point to another point for half a second, and rotates back to the starting point for another half second. The tape 21 preferably tells the time every half hour or every hour.

Figure 2:
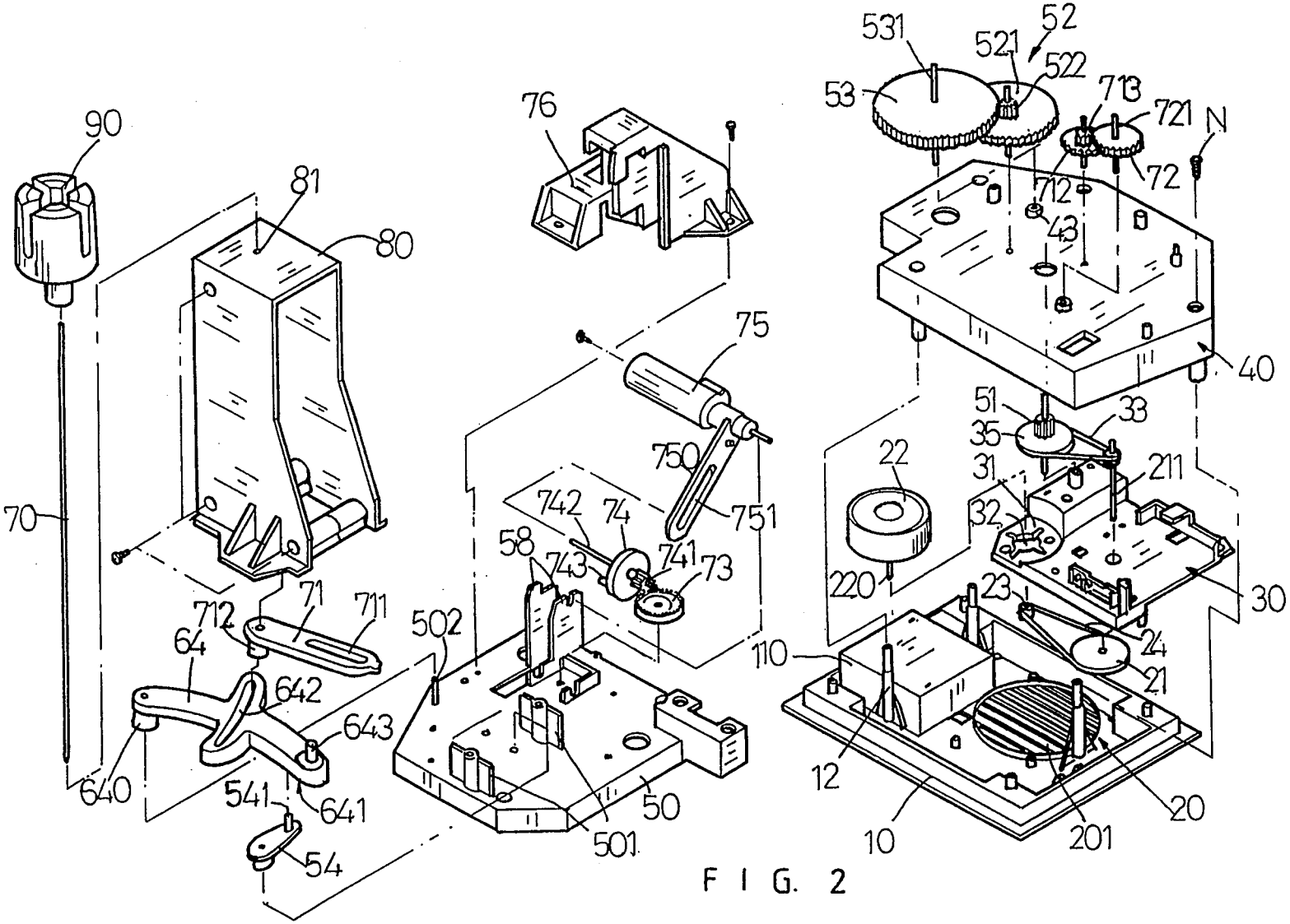
FIG. 2 is an exploded view illustrating another embodiment of the clock assembly.

Referring next to FIG. 2, illustrated is another embodiment of the clock assembly which also includes a base 10 having a seat 30 and a frame 40 fixed thereon, a tape 21 actuated by a motor 22 via a belt 24, a pinion 51 formed integral with a pulley 35 and coupled to the tape 21 by a shaft 211 and a belt 33 and engaged with a gearing 52 for rotating a gear 53 and the spindle 531 of the gear 53, the base 10 further includes a casing 110 for accommodating batteries, and the tape device 20 includes a speaker 201, a board 50 fixed above the frame 40, a lever 54 having one end secured to the spindle 531 which extends upward beyond the board 50, the board 50 includes two panels 501 for supporting the casing 80. The board 50 includes a pin 502 extended upward therefrom, a limb 64 has a hub 640 formed on one end and rotatably engaged on the pin 502, a free end 641 of the limb 64 is engaged with an extension 541 of the lever 54 such that the limb 64 may be rotated about the pin 502 with a reciprocating action by the lever 54 when the lever 54 is rotated by the motor 22 via the gearing 52, a leg 71 has a hub 712 fixed to a rod 70 and slidably engaging in a slot 642 of the limb 64 and has a groove 711 slidably engaging with a projection 643 of the limb 64 such that the rod 70 may also be rotated in a reciprocating action by the limb 64 and the leg 71.

The gearing mechanism 52 further includes a gear 712 engaged with the pinion 51 and having a pinion 713 for engaging with another gear 72 which has a spindle 721 extended upward beyond the board 50, a crown gear 73 fixed to the spindle 721 and engaged with a pinion 741 which is fixed one the spindle 742 of a disc 74 such that the disc 74 may be rotated by the motor 22 via the gears 712, 72, 74, 741, the spindle 742 is rotatably supported on two support members 58 of the board, an arm 75 has a groove 751 formed in an extension 750 thereof for engaging with a projection 743 of the disc 74 such that the arm 75 may be rotated in a reciprocating action when the disc 74 is rotated. A cap 76 may be provided to partly cover the arm 75, and the arm 75 may simulate the arm of creature.

In operation, both the head 90 and the arm 75 may be rotated in a reciprocating action.

Figure 3:
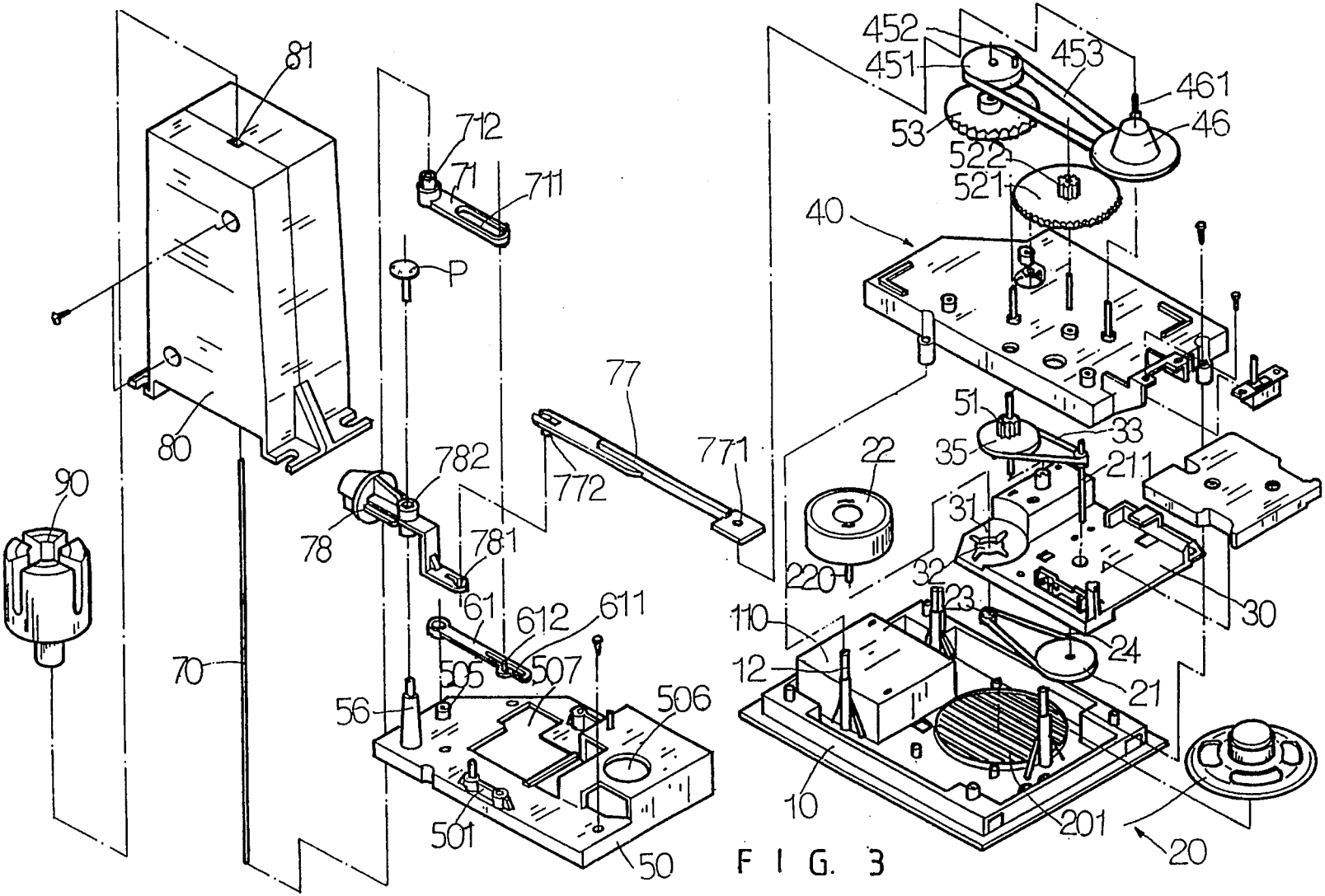
FIG. 3 is an exploded view illustrating still another embodiment of the clock assembly.

Referring next to FIG. 3, illustrated is still another embodiment of the clock assembly which also includes a base 10 having a seat 30 and a frame 40 fixed thereon, a tape 21 actuated by a motor 22 via a belt 24, a pinion 51 formed integral with a pulley 35 and coupled to the tape 21 by a shaft 211 and a belt 33 and engaged with a gear 521 and a pinion 522 for rotating another gear 53, the base 10 further includes a casing 110 for accommodating batteries, and the tape device 20 includes a speaker 201, a board 50 fixed above the frame 40 and including two panels 501 for supporting the casing 80 and including a pin 56 extended upward therefrom. A leg 71 has a hub 712 fixed to a rod 70 and has a groove 711.

A pulley 451 is secured to the gear 53 and rotated in concert with the gear 53 and coupled to another pulley 46 by a belt 453, two pins 452, 461 extend upward from the pulleys 451, 46 and extend upward beyond the board 50 via two openings 506, 507. A lever 61 has one end pivotally supported upon the board 50 by a hub 505 and has a groove 611 for engaging with the pin 452 such that the lever 61 may be rotated when the pulley 451 is rotated, the lever 61 further includes a pin 612 extended upward for engaging with the groove 711 of the leg 71 such that the head 90 and the rod 70 may be rotated in a reciprocating action when the leg 71 is rotated. A limb 78 has a middle portion 782 rotatably supported on the pin 56 and has a groove 781 formed in one end, a link 77 has one end 772 slidably engaged with the groove 781 and has the other end 771 engaged with the pin 461 such that the limb 78 may be rotated about the pin 56 when the pulley 46 is rotated.

Figure 4:
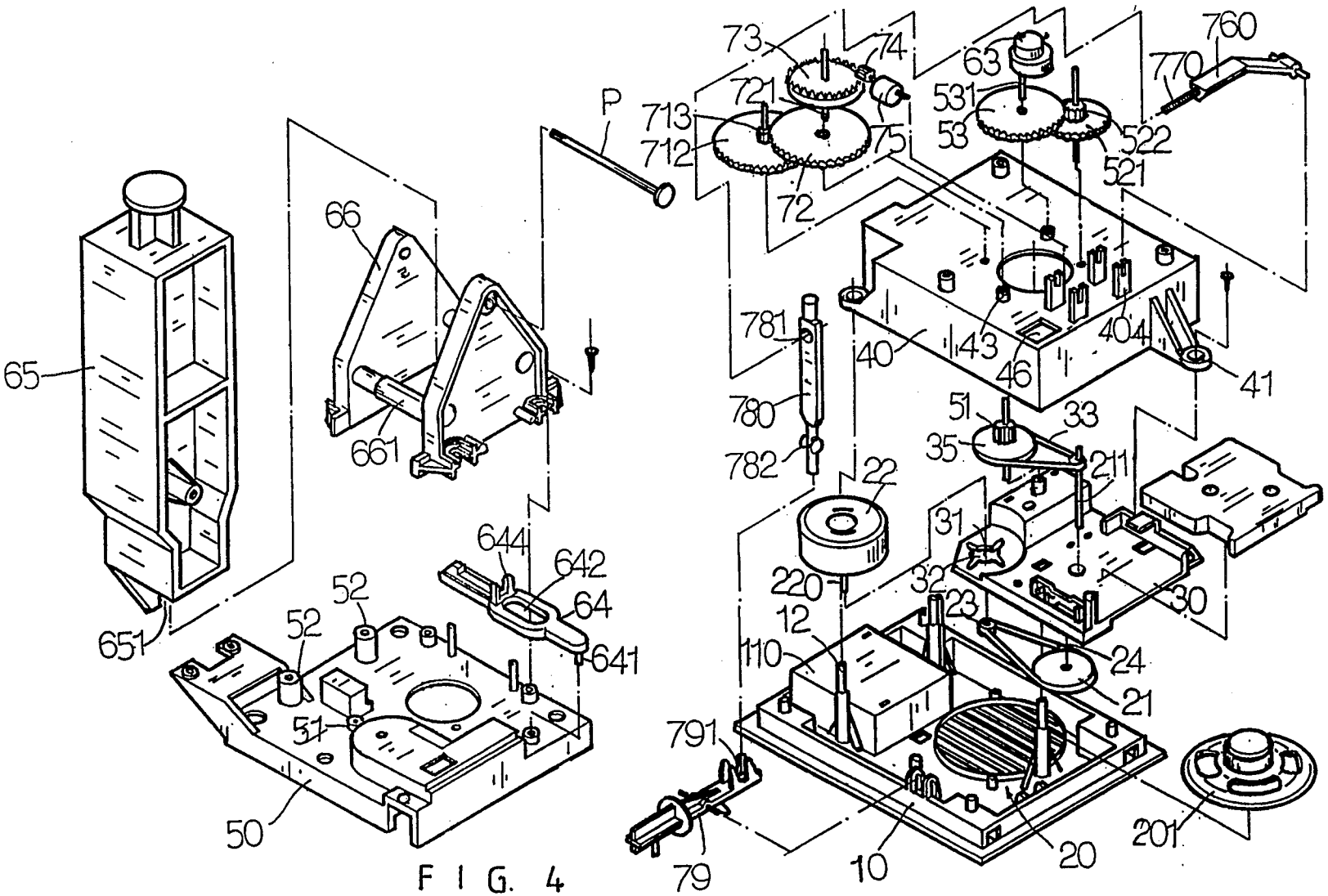
FIG. 4 is an exploded view illustrating a further embodiment of the clock assembly.

Referring next to FIG. 4, a body 65 has a middle portion pivotally supported on a frame 66 by a pin P, two pins 661 fixed in the frame 66 for limiting rotational movement of the body 65 which may simulate a human body or the like, the frame 66 is fixed on the stubs 52 of the board 50, a cam 63 is fixed on the spindle 531 of the gear 53 and extends upward beyond the board 50, a limb 64 has one end 641 pivotally coupled to the board 50 and has a groove 642 for slidably engaging with the cam 63 such that the limb 64 can be rotated by the cam 63, the limb 64 further includes a projection 644 for engaging with a notch 651 of the body 65 so as to rotate the body 65 when the limb 64 is rotated, such that the body 65 may be rotated in order to simulate a human body. A crown gear 73 and a gear 53 may also be rotated by the motor 22 in order to rotate a pinion 74 which has a cam 75 secured thereto, an arm 760 is engaged with the cam 75 and has one end pivotally coupled to the frame 40 by a pair of supports 404, a leg 79 has a middle portion pivotally supported on the base 10, a link 780 has a pair of projections 782 for engaging with a notch 791 of the leg 79 and has an aperture 781 formed therein for engaging with a resilient member 770 which is extended outward from the arm 760, such that the leg 79 can be rotated when the link 780 is moved up and down by the arm 760 and the cam 75, and such that the leg 79 may simulates the legs of human body.

Figure 5:
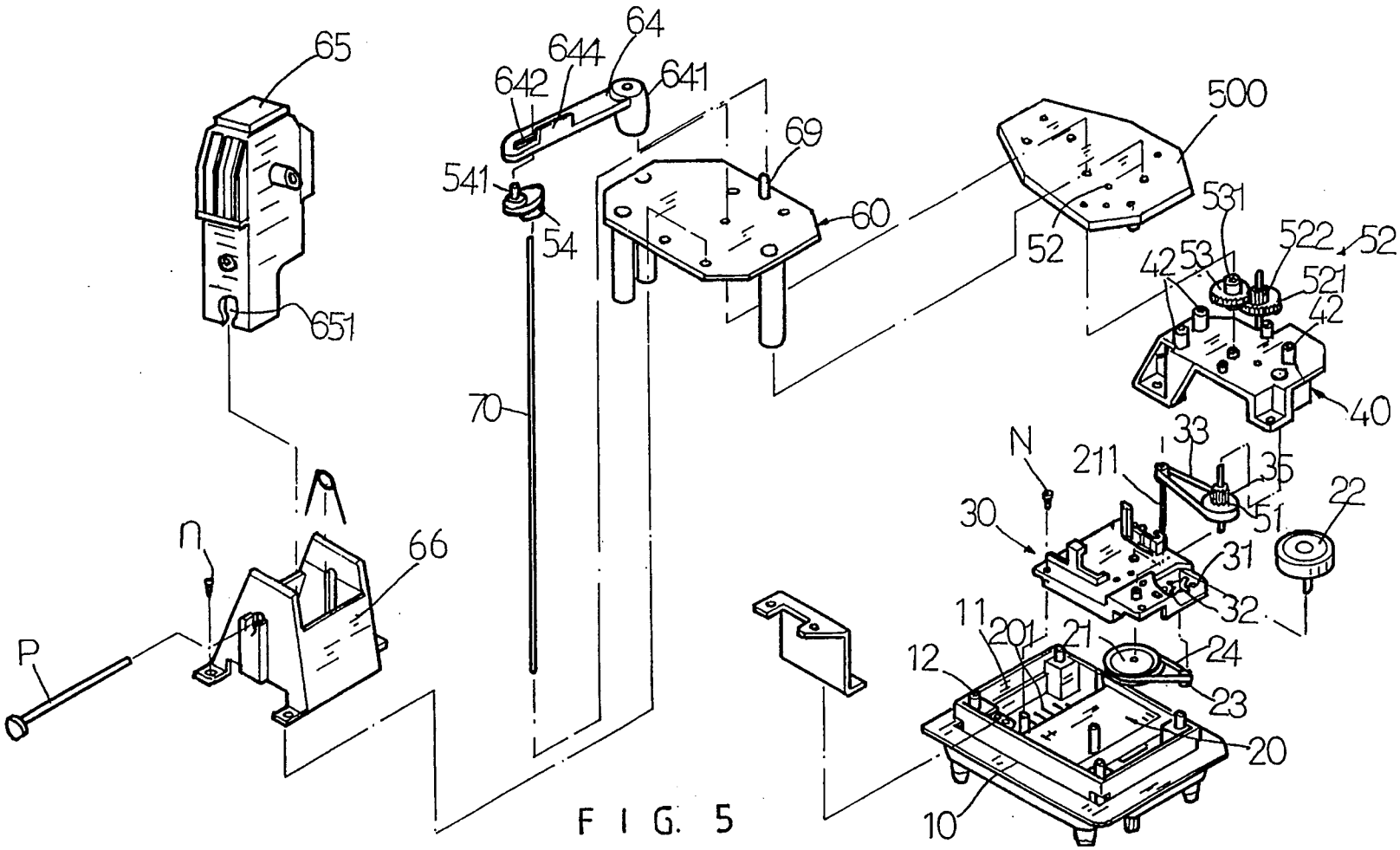
FIG. 5 is an exploded view illustrating still a further embodiment of the clock assembly.

Referring next to FIG. 5, a gear 53 may also be rotated by the motor 22, two boards 500 and 60 are fixed above the frame 40, a body 65 has a middle portion pivotally supported on a frame 66 by a pin P, two pins 661 fixed in the frame 66 for limiting rotational movement of the body 65 which may simulate a human body or the like, the frame 66 is fixed above the board 60, a rod 70 has a lower end extended downward through the boards 500, 60 and fixed to the hub 531 of a gear 53 such that the rod 70 rotates in concert with the gear 53, a lever 54 has one end fixed on top of the rod 70 and includes an extension 541 extended upward therefrom, a limb 64 has one end 641 pivotally coupled to the board 60 by a pin element 69 and has a groove 642 for slidably engaging with the extension 541 such that the limb 64 can be rotated by the extension 541 when the rod 70 is rotated by the motor 22, the limb 64 further includes a projection 644 for engaging with a notch 651 of the body 65 so as to rotate the body 65 when the limb 64 is rotated, such that the body 65 may be rotated in order to simulate a human body.

Accordingly, the clock assembly in accordance with the present invention may include a head, a body, a leg and a limb for simulating that of a creature.

I claim:

1. A clock assembly comprising a base, a seat and a frame fixed above said base, a motor fixed on said seat, a tape device for telling time being disposed in said base and coupled to said motor so as to be driven by said motor, a spindle rotatably supported on said frame, means coupling said tape to said spindle for rotating said spindle, a lever having a first end secured to said spindle and rotated in concert with said spindle and including an extension extended upward therefrom, a rod rotatably supported on said frame and including a leg laterally extended therefrom and having a groove formed therein for engaging with said extension of said lever such that said rod is rotated when said lever is rotated by said motor, a head fixed on top of said rod and rotated in concert with said rod for simulating the head of creature.

2. A clock assembly comprising a base, a seat and a first frame fixed above said base, a motor fixed on said seat, a tape device for telling time being disposed in said base and coupled to said motor so as to be driven by said motor, a spindle rotatably supported on said first frame, means coupling said tape to said spindle for rotating said spindle when said tape is driven by said motor, a second frame fixed on said first frame, a body including a middle portion pivotally supported on said second frame and including a lower portion, a rod including a lower end secured to said spindle, a lever having a first end secured to said rod and including a second end having an extension extended upward therefrom, a limb including a first end pivotally supported on said first frame and including a groove formed therein for engaging with said extension such that said limb is rotated when said lever is rotated with said rod, said limb including a projection for engaging with said lower portion of said body for rotating said body when said limb is rotated by said extension, in order for simulating the body of creature.

3. A clock assembly according to claim 2 further comprising an arm rotatably supported on said first frame, said arm including a second groove formed therein, a disc including a second projection slidably engaging with said second groove of said arm, gearing means coupling said spindle to said disc so as to rotate said disc in order to rotate said arm, said arm being rotated in order to simulate an arm of creature.

4. A clock assembly according to claim 2 further comprising a leg including a middle portion rotatably supported on said first frame, an arm pivotally supported on said first frame and including a first end, a link coupling said first end of said arm to said leg for rotating said leg, and cam means coupled to said spindle for rotating said arm in order to rotate said leg so as to simulate a leg of creature.

* * * * *